United States Patent [19]

Iwasaki

[11] 4,438,751

[45] Mar. 27, 1984

[54] HIGH VOLTAGE GENERATING CIRCUIT FOR AN AUTOMOTIVE IGNITION SYSTEM

[75] Inventor: Shinichiro Iwasaki, Troy, Mich.

[73] Assignee: Aisin Seiki Kabushiki Kaisha, Kariya, Japan

[21] Appl. No.: 489,189

[22] Filed: Apr. 27, 1983

Related U.S. Application Data

[63] Continuation-in-part of Ser. No. 383,607, Jun. 1, 1982, and Ser. No. 268,889, Jun. 1, 1981, Pat. No. 4,382,430.

[51] Int. Cl.[3] ..... F02P 1/00

[52] U.S. Cl. ..... 123/606; 123/637; 123/643

[58] Field of Search ..... 123/606, 607, 608, 636, 123/637, 643, 644

[56] References Cited

U.S. PATENT DOCUMENTS

| | | | |
|---|---|---|---|
| 3,408,536 | 10/1968 | Tibbs | 123/607 X |
| 3,945,362 | 3/1976 | Nedman et al. | 123/606 |
| 3,973,544 | 8/1976 | Suda | 123/637 X |
| 4,149,508 | 4/1979 | Kirk, Jr. et al. | 123/606 X |
| 4,181,112 | 1/1980 | Grather et al. | 123/606 |
| 4,245,594 | 1/1981 | Morino et al. | 123/606 |
| 4,349,008 | 9/1982 | Wainwright | 123/606 X |
| 4,380,989 | 4/1983 | Takaki | 123/606 X |

*Primary Examiner*—Tony M. Argenbright

*Attorney, Agent, or Firm*—Oblon, Fisher, Spivak, McClelland & Maier

[57] ABSTRACT

A high voltage generating circuit for an automotive ignition system, wherein a current control circuit is provided in series with an automotive battery and a controlled high frequency switch to generate a high frequency, linearly increasing ignition current across the electrodes of the spark plugs of an internal combustion engine in order to accommodate shifts in the spark plug sustaining voltage which may occur due to changes in operating conditions. In a preferred embodiment, a DC-DC converter is inserted in series between the battery and the current control circuit to step-up the voltage applied to the current control circuit.

14 Claims, 11 Drawing Figures

FET
ON
OFF
ON
OFF
ON
$I_1$
0
$t_0$
$t_1$
$t_2$
$t_3$
$t_4$
$t_5$
$I_R$
0
$V_L$
$V_L$
VOLTAGE AT SPARK PLUG (VOLTAGE AT SEC. WINDING OF TRANSFORMER)
0
+VS
-VS
BREAKDOWN
CURRENT AT SPARK PLUG
0
$t_1$
$t_2$
$t_3$
$t_4$
$t_5$

HIGH VOLTAGE GENERATING CIRCUIT FOR AN AUTOMOTIVE IGNITION SYSTEM

CROSS-REFERENCE TO RELATED APPLICATIONS

This application is a continuation-in-part of U.S. Pat. application Ser. No. 268,889 filed June 1, 1981 now Pat. No. 4,382,430, and U.S. Pat. application Ser. No. 383,607 filed June 1, 1982.

BACKGROUND OF THE INVENTION

1. Field of the Invention

This invention relates to a high voltage generating cirucit for an automobile ignition system, and more particularly to such a high voltage generating circuit for applying high frequency pulse signals to plural spark plugs during each spark plug ignition.

2. Description of the Prior Art

High voltage generating circuits of the above-noted type are known in the prior art, as for example disclosed in U.S. Pat. No. 4,245,594 to Morino et al. While the prior art high voltage generating circuits perform well under some engine operating conditions, nevertheless an ignition current within an optimum range of about 30–100 mA cannot always reliably be obtained at the spark plug because the spark sustaining voltage changes in accordance with various engine conditions while the supply voltage is constant. In the event that an ignition current less than 30 mA is realized, than one cannot obtain adequate engine performance and engine emissions increase. Ignition currents higher than 100 mA on the other hand results in early spark plug wear out and tend to destroy circuit elements within the ignition circuit.

FIG. 1 illustrates the spark plug ignition current $I_s$ versus sustaining voltage $V_s$ characteristic. The curves "a", "b" and "c" indicate $I_s$–$V_s$ relations under different engine conditions. Curve "b", for example, indicates a very stable voltage $V_s$ within a very wide current range $I_s$ when a current is supplied to the spark plug from a fixed power supply source. Circuit parameters are then selected for operation at a selected $I_s$–$V_s$ point, for example, at point A shown in FIG. 1, considering the voltage level of the fixed power supply source. However, if engine conditions, such as vacuum pressure, temperature etc., change, the curve "b" may be shifted to the right to curve "c", where $I_s$ becomes zero, or on the other hand may be shifted to curve "a" where $I_s$ becomes very large. However, as above noted, when $I_s$ is below the optimum range, the efficiency of fuel consumption decreases and the amount of pollutants in the exhaust gases is increased, and when $I_s$ is above the optimum range, early spark plug wear out occurs and ignition circuit elements experience a greater number of failures.

SUMMARY OF THE INVENTION

Accordingly, one object of this invention is to provide a novel high voltage generating circuit for an automotive ignition system in which fuel consumption efficiency is improved and in which the amount of pollutants produced is decreased.

Another object of this invention is to provide a high voltage generating circuit of the above-noted type wherein an optimum spark plug ignition current can be obtained in accordance with various engine conditions, even if a spark sustaining voltage changes.

A further object of this invention is to provide a novel high voltage generating circuit including an ignition transformer reduced in size while nevertheless keeping the capacity the same.

Yet another object is to provide a circuit as above noted which improves engine efficiency by applying a high frequency signal to the spark plugs of an internal combustion engine, whereby the discharge period of the spark plug is increased.

These and other objects are achieved according to the present invention by providing a new and improved high voltage generating circuit for an automotive ignition system, including a current controlling circuit provided between a DC voltage power supply and an automotive switching circuit coupled to a spark plug, wherein the switching circuit is switched ON and OFF at a high frequency during selected periods of each revolution of an internal combustion engine, such that a long duration discharge within the optimum current range is produced across the electrodes of the spark plug regardless of engine conditions.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 2:
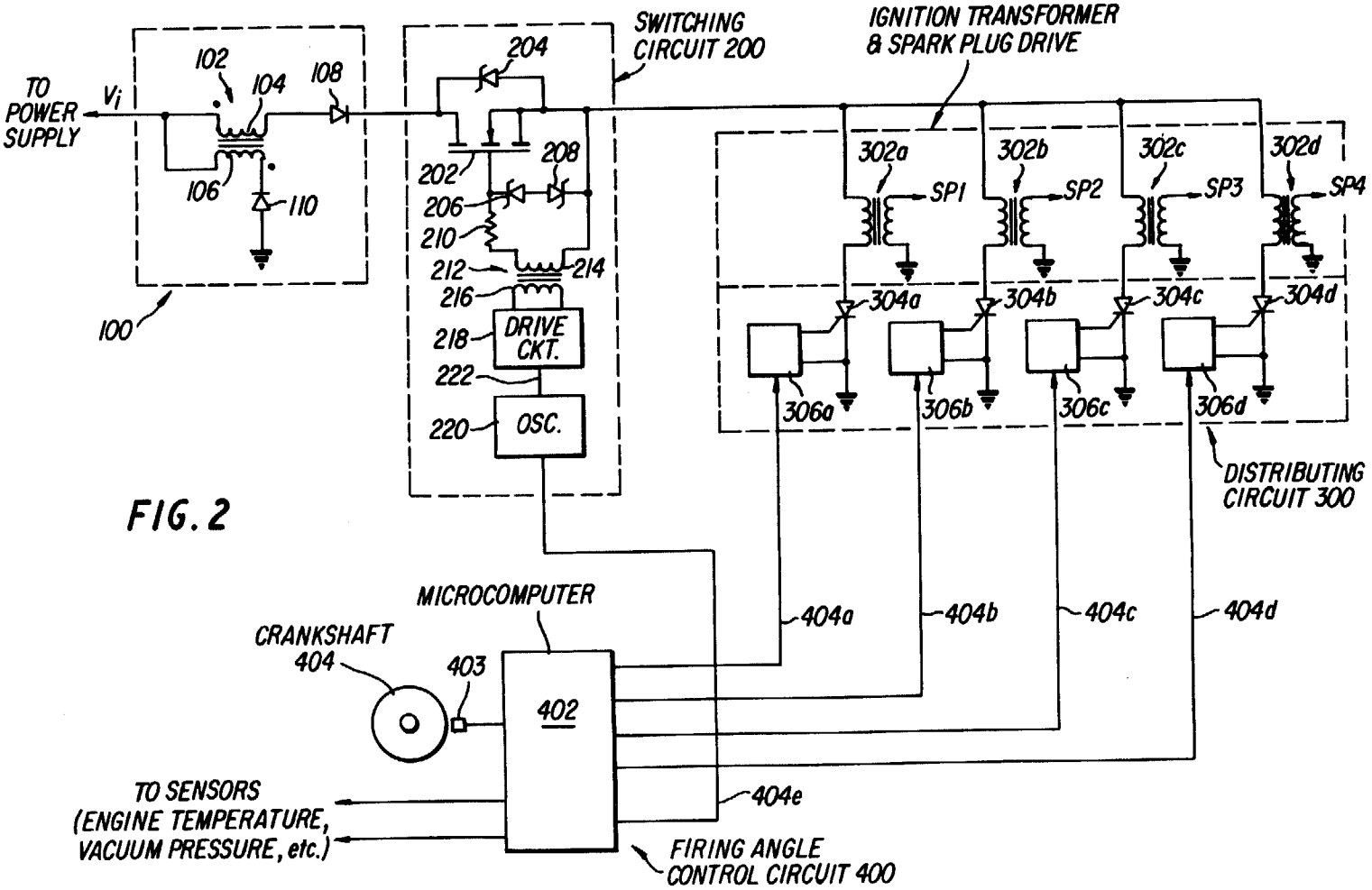
FIG. 2 is a schematic circuit diagram of the high voltage generating circuit of the invention.

Referring now to the drawings, wherein like reference numerals designate identical or corresponding parts throughout the several views, and more particularly to FIG. 2 thereof, the high voltage generating circuit of Applicants' invention is shown as including a current control circuit 100, a switching circuit 200, an ignition transformer and spark plug circuit 300, and a firing angle control circuit 400. In the preferred embodiment shown in FIG. 2, the current control circuit 100 has an input which is coupled to a power supply (not shown) which may be a battery of an automobile, or in the embodiment discussed in more detail hereinafter in connection with FIG. 6, may be a DC-DC converter which produces a stepped-up battery voltage. Current control circuit 100 is designed to produce a linearly increasing ignition current, as hereinafter described.

Circuit 100 includes a transformer 102 having a primary winding 104 and a secondary winding 106. Primary winding 104 is connected in series with the power supply and the anode of a diode 108, the cathode of which is coupled to the switching circuit 200. The secondary winding 106 has one side thereof also connected to the power supply, and the other side thereof connected to the cathode of a diode 110, the anode of which is connected to ground, i.e., the vehicle chassis.

Switching circuit 200 includes a power MOS FET 202 having source and drain terminals connected in series between the cathode of diode 108 and the ignition transformer and spark plug drive circuit 300. Shunting the MOS FET 202 is a zener diode 204 which limits the voltage across the drain and source terminals of the MOS FET 202. Connected in series between the gate and drain terminals of the MOS FET 202 is a series circuit formed of zener diodes 206 and 208 which have the anodes thereof interconnected, and which limit the maximum gate-drain voltage across the MOS FET 202. Also shunting the gate and drain terminals of the MOS FET 202 is a series combination of a resistor 210 and the secondary winding 214 of a transformer 212. Transformer 212 includes a primary winding 216 coupled to a drive circuit 218 which in turn is coupled to a gated ocsillator 220. Upon application of a control signal to the oscillator 220, a series of pulses is applied via the drive circuit 218 and the transformer 212 to the gate of the MOS FET 202, whereby MOS FET 202 is alternately rendered fully conductive (ON) and nonconductive (OFF) in accordance with the waveform produced by the gated oscillator 220.

The ignition transformer and spark plug drive circuits in Applicants' preferred embodiment includes plural ignition transformers 302*a*, 302*b*, 302*c* and 302*d*, one for each cylinder of the engine. Each ignition transformer includes a primary winding having one end connected to the drain of the power MOS FET and another end connected to a respective SCR switch 304*a*, 304*b*, 304*c* and 304*d*. The gate and cathode terminals of each SCR switch in turn is connected to a respective SCR drive circuit 306*a*, 306*b*, 306*c* and 306*d*, the individual details of which are shown in FIG. 5.

Figure 3:
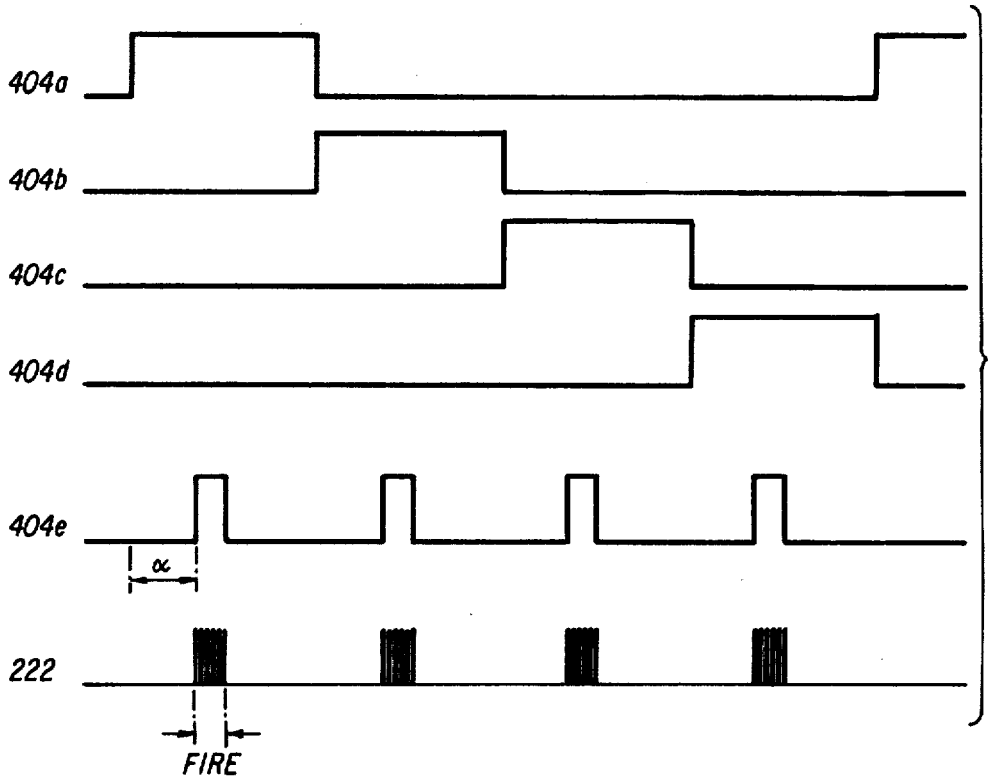
FIG. 3 is a timing diagram illustrating firing angle control signals generated by operation of the firing angle control circuit shown in FIG. 2.

Firing angle control circuit 400 is schematically shown in FIG. 2 as including a microcomputer 402, and is of conventional design. Microcomputer 402 is coupled via a sensor 403 to a crank shaft of the engine to detect rotational position of the engine, in addition to various sensors monitoring, for example, engine temperature, vacuum pressure, etc. As is well known to those skilled in the art, a microcomputer 402 produces output signals 404*a*, 404*b*, 404*c*, 404*d*, shown in FIG. 3, which are representative of the rotational position of the crank shaft 404. Based on the rotation position of the crank shaft 404, and based on various parameters such as engine temperature, vacuum pressure, and so forth as above noted, the microcomputer produces a spark advance signal 404*e* which is applied as a gating signal to the gated oscillator 220 to initiate spark plug ignition at the requisite advance angle for each of the plural spark plugs of an internal combustion engine. The signal 222 shown in FIG. 3 illustrates the output of the gated oscillator 220 upon application of a signal 404*e* thereto.

Figure 1:
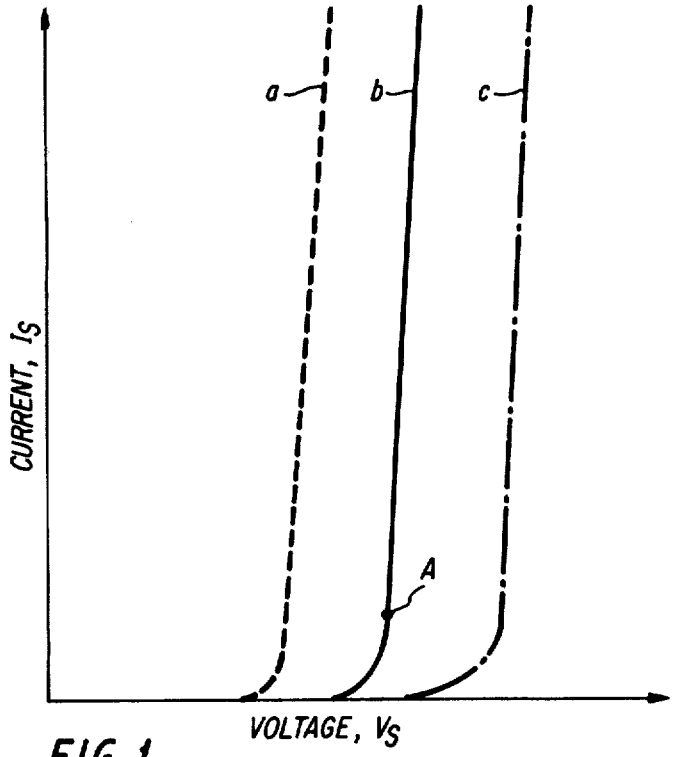
FIG. 1 is a graph illustrating spark plug current versus voltage characteristics.
Figure 5:
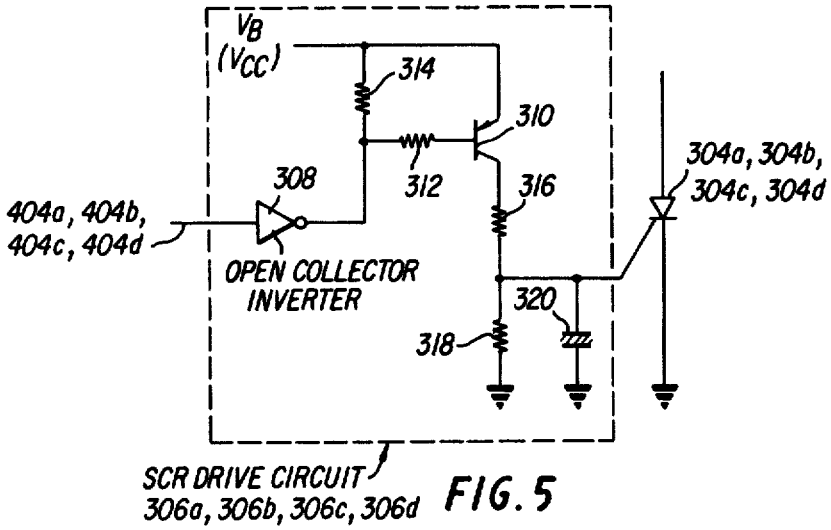
FIG. 5 is a circuit diagram showing an SCR drive circuit shown in FIG. 2.

As above-noted, FIG. 5 illustrates the details of the SCR drive circuit 306*a*, it being understood that this drive circuit is identical to the other drive circuits 306*b*, 306*c*, 306*d*. Drive circuit 306*a* includes an open collector interter 308 having an input coupled to a respective output 404*a* of the microcomputer 402 and an output coupled to the base of a pnp transistor 310 via a resistor 312. The output of inverter 308 is also coupled to a battery voltage $V_b$ via resistor 314.

Figure 6:
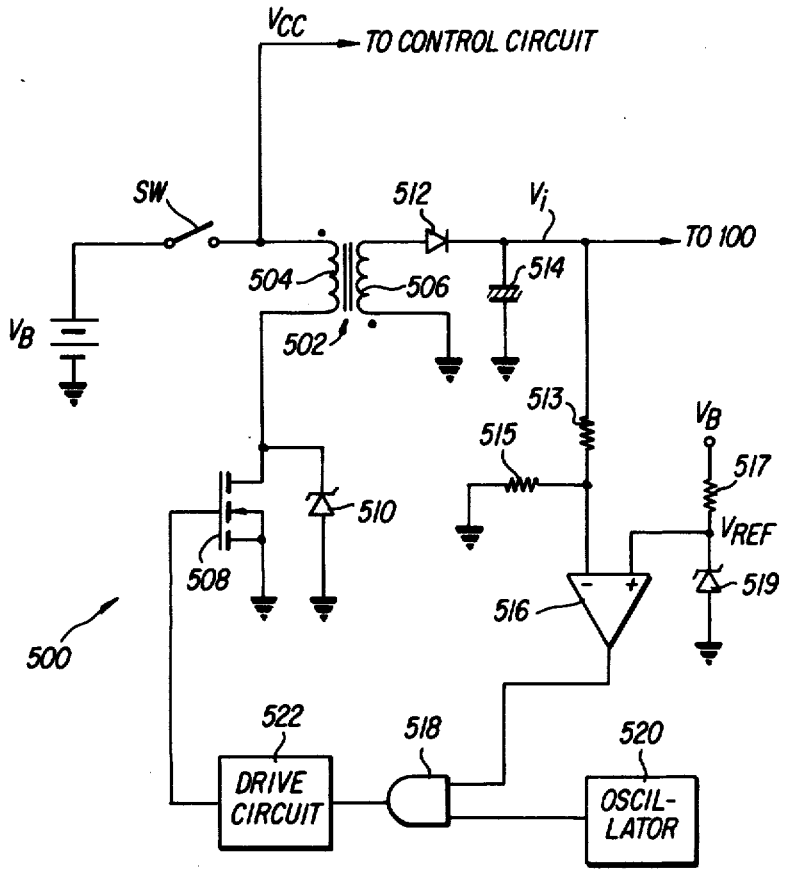
FIG. 6 is a circuit diagram of a DC-DC converter employed in another embodiment of the present invention.

Operation of the high voltage generating circuit of the present invention is nextly described. The current control circuit 100 as above described is connected at one end thereof to the power supply, preferably through a DC-DC converter as shown in FIG. 6, and at the other end thereof connected to the switching circuit 200 for supplying a controlled output current to the circuit 200. When the switching circuit 200 is ON, i.e., the power MOS FET is ON, and the current as supplied by the control circuit 100 increases at a predetermined rate due to the inductance of the transformer 102. The MOS FET 102, which may be implemented by means of an International Rectifier Model No. IRF830 series FET, turns ON or OFF, i.e. conducting or non-conducting, in response to the high or low signals 222 produced by gating of the gated oscillator 220. During times when MOS FET 202 is ON, a current is passed from the power supply to the current control circuit 100 through the MOS FET 202 and is introduced to the primary winding of a selected of the ignition transformers 302*a*–302*d*. The selection of the particular transformer is determined by the ON/OFF condition of the respective SCR 304*a*–304*d* in dependence upon activation of the respective drive circuit 306*a*–306*d* by the microcomputer 402.

Figures 4A, 4B, 4C, 4D, 4E, 4F:
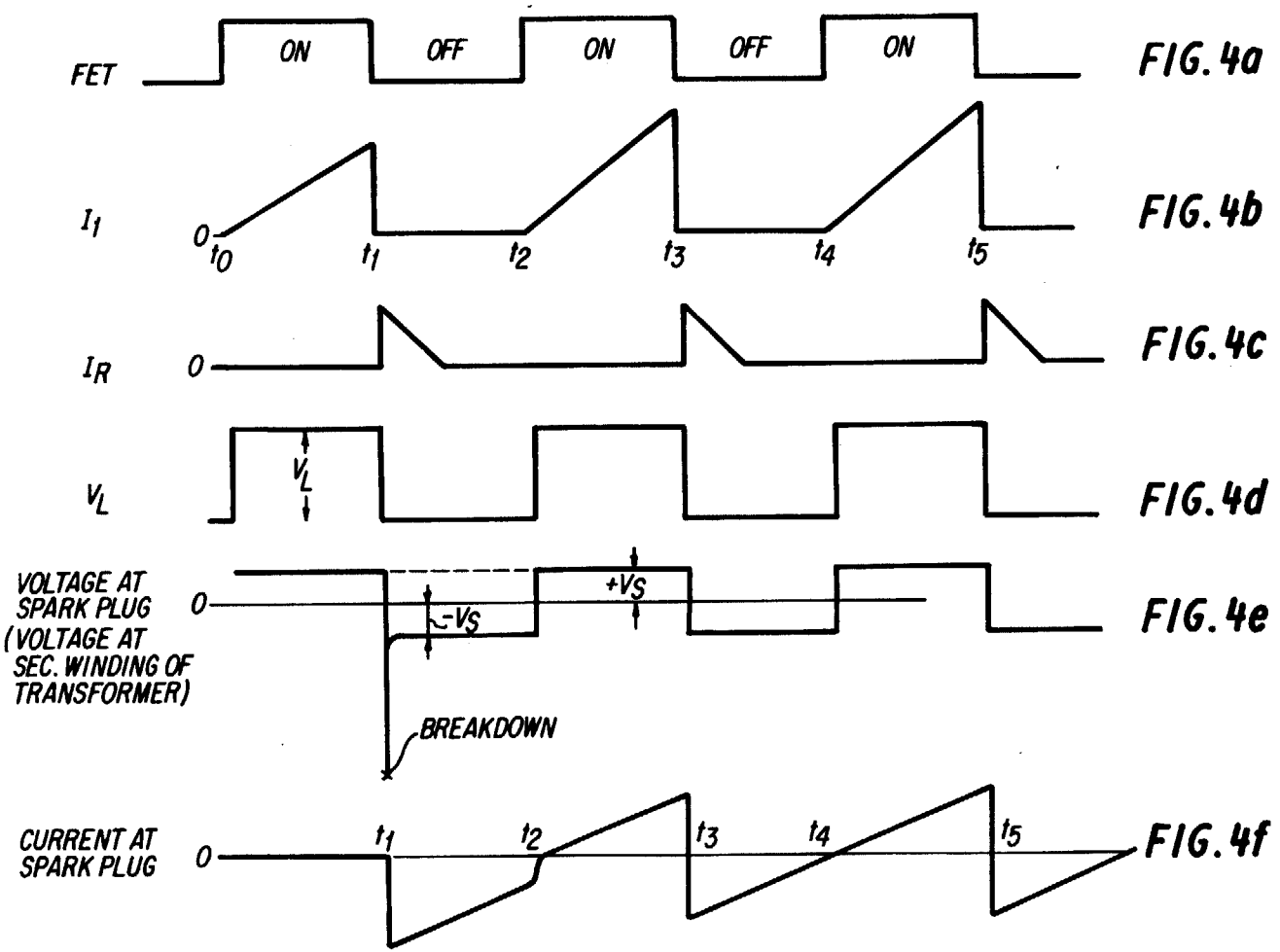
FIGS. 4*a*–4*f* are timing diagrams illustrating additional waveforms at selected points in the high voltage generating circuit shown in FIG. 2.

FIGS. 4*a*–4*f* illustrate various voltage and current waveforms existing in the circuit shown in FIG. 2. FIG. 4*a* illustrates the ON/OFF state of the power MOS FET 202 under the control of the signal 402*e* generated by the microcomputer 402. Each ON period of the FET shown in FIG. 4*a* corresponds to a selected polarity of the output 222 of the oscillator 220. FIG. 4*b* illustrates the current $I_i$ at the drain of the MOS FET. Current $I_i$ is applied to the primary winding of a selected ignition transformer 302*a*–302*d*. Upon activation of the respective SCR 304*a*–304*d*, and upon the FET 220 being switched ON, current $I_i$ in the primary winding of a selected ignition transformer 302*a*–302*d* increases from a time $t_0$ to a time $t_1$ in accordance with the following relationship:

$$I_i = \frac{V_i}{L_1 + L_2} t \tag{1}$$

wherein $L_1$ = inductance of primary winding 104 of transformer 102

$L_2$ = inductance of primary winding of any one of the transformers 302*a*–302*d*

$V_i$ = input voltage to the current control circuit 100

At time $t_1$, the MOS FET 202 is switched OFF whereupon the inductive energy charged at the selected ignition transformer 302*a*–302*d* is discharged by charging the stray capacitance at the secondary winding of the selected ignition transformer. This results in ionization of the gaseous mixture between the electrodes of the spark plug connected to the respective ignition transformer, whereby breakdown occurs. Thereupon, the voltage across the secondary winding of the selected ignition transformer decreases to the sustaining voltage $V_s$ and stays at the sustaining voltage for the duration of the OFF cycle of the power MOS FET.

FIG. 4*c* illustrates the reset current in the secondary winding 106 of the transformer 102 of the current control circuit 100. This reset current $I_R$ occurs when the MOS FET 202 enters the non-conducting OFF state. Accordingly, the core of the transformer 102 is completely reset during the time when the switching circuit MOS FET is OFF. FIG. 4*d* illustrates the voltage waveform at the drain output of the MOS FET 202.

Recapitulating the operation as above described, when the voltage $V_s$ across the secondary winding of the selected ignition transformer reaches the breakdown voltage of the spark plug connected thereto, the spark plug begins discharging due to ionization of the gaseous mixture between the electrodes thereof, whereupon the voltage across the spark plug electrodes rapidly decreases, as does the voltage at the secondary winding of the respective ignition transformer, until the sustaining voltage $V_s$ is reached. The sustaining voltage $V_s$ is maintained for the duration of the OFF cycle of the MOS FET from $t_1$ to $t_2$ as shown in FIG. 4*e*. As shown in FIG. 4*f* the current in the secondary winding of the ignition transformer, which is also the current in the spark plug, in the time interval from $t_1$ to $t_2$ is increasing from a negative number at time $t_1$ to zero at time $t_2$ at a predetermined rate. On the other hand, at time $t_1$ as above noted the inductive energy charged at the transformer 102 of the current control circuit 102 returns to the power supply through the secondary winding 106 and the diode 110, whereby the core of transformer 102 is completely reset during the time when the MOS FET 202 is in the non-conducting OFF state.

When the switching circuit 200 again enters the conducting ON state at time $t_2$, the current $I_i$ at the output drain current of the MOS FET 202 again increases at a predetermined rate, and is as follows:

$$I_i = \frac{V_i - V_o}{L_1} t \quad (2)$$

wherein:

$$V_o = \frac{1}{N} \times V_s \quad (3)$$

and $V_s$=sustaining voltage of spark plug

N=turns ratio of secondary winding to primary winding of ignition transformers 302*a*–302*d*

The current $I_T$ charged at a transformer 302*a*–302*d* as inductive energy may be shown as follows:

$$I_T = \frac{V_o}{L_2} t \quad (4)$$

Thus, the current $I_s'$ to the primary winding of the selected ignition transformer is $$I_s = I_i - I_T = \frac{V_i - V_o}{L_1} - \frac{V_o}{L_2} t \quad (5)$$

The current $I_s$ actually transmitted to the spark plug is $$I_s = \frac{1}{N} I_s \quad (6)$$

At the time $t_3$ shown in FIG. 4*a*, the power MOS FET 202 enters the OFF state, whereupon the inductive energy charged at the ignition transformer is discharged. However, since the gap between the electrodes of the spark plug has already ionized at time $t_3$, the voltage $V_s$ stays at its negative sustaining voltage, $(-V_s)$, and does not increase, in absolute value terms, to a breakdown level.

Accordingly, since the system of the present invention employs the current control circuit 100, the current $I_s$ of the spark plug increases gradually when the switching circuit 200, and more particularly MOS FET 202, is in the ON conducting state during the time period from $t_2$ to $t_3$, $t_4$ to $t_5$, and so forth as shown in FIG. 4*f*.

The spark plug current $I_s$ is maintained below a predetermined level by selection of the ON time period of the switching circuit 200. Excess current flow to the switching circuit 200, and particularly the MOS FET 202, or to the selected SCR 304*a*–304*d* is thus prevented.

Operation of the SCR drive circuit shown in FIG. 5 is readily understood by inspection. When the input signal 404*a*–404*d* applied to the input of the inverter 308 is high or a logic "1", the output of the inverter 300 goes low or to a logic "0", whereupon the transistor 310 becomes conductive (ON). Connected to the collector of the transistor 310 is a series combination of a resistor 316 and the parallel combination of a resistor 318 and a capacitor 320. The junction between resistors 316 and 318 and capacitor 320 is connected to the gate of a respective SCR 304*a*–304*d*, whereas the opposite sides of resistor 318 and capacitor 320 are grounded. When transistor 310 is turned ON, a voltage is developed across resistor 318 and capacitor 320 which is applied to the gate of the corresponding SCR 304*a*–304*d* causing conduction through the respective SCR. Capacitor 320 prevents erroneous operation of the SCR and improves the dv/dt performance of the SCR.

A preferred embodiment of the present invention is now described referring to FIG. 6. As above-noted, this preferred embodiment includes a DC-DC converter 500 connected between the vehicle battery $V_b$ and the current control circuit 100. As shown in FIG. 6, the DC-DC converter 500 is coupled to the vehicle battery $V_b$ via the dashboard ignition switch SW, and includes a transformer 502 having a primary winding 504 and a secondary winding 506. The primary winding 504 is connected in series between the switch SW with an FET 508 connected in parallel with a zener diode 510, which are grounded on the sides thereof opposite the connection to the primary winding 504. The secondary winding 506 has one side thereof grounded and the other side connected to the anode of diode 512. The cathode of diode 512 is connected in series with a capacitor 514 to ground. The junction between diode 512 and 514 is connected to the transformer 102 of the current control circuit 100 and provides the circuit 100 with the input voltage $V_i$ as shown in FIG. 2. Also connected to the junction between diode 512 and capacitor 514 is the series combination of resistors 513, 515, the junction of which is connected to the negative input of a comparator 516. The positive input of comparator 516 in turn is connected to a reference voltage $V_{REF}$, which is from the voltage $V_R$ through the series combination of a resistor 517 and zener diode 519 as shown. The output of the comparator 516 is connected to one input of a two input AND gate 518, the other input of which is connected to an oscillator 520. The output of the AND gate 518 is connected to a drive circuit 522, which has an output connected to the gate of FET 508. At the junction between the primary winding 504 and the switch SW, it is possible to pick off a voltage $V_{cc}$ serving as a power supply voltage in the SCR drive circuit shown in FIG. 6.

The FIG. 6 DC-DC converter is of the ringing or fly back converter type and increases or steps-up the supply voltage $V_b$ supplied to the current control circuit from, for example, the 12 volt vehicle battery level to a level of 40 volts, in order to transmit a desired current to the current control circuit 100.

In the circuit 500, the FET 508 is ON/OFF controlled by the oscillator 520 and the drive circuit 522. When the FET 508 is ON, a current is introduced from the battery $V_b$ to the primary winding 504 of the transformer 502, whereby the transformer 502 is supplied with inductive energy. When the FET 508 is then switched OFF, the inductive energy stored in the transformer 502 is discharged from the secondary winding 506 charging the capacitor 514. Upon repetitious ON/-OFF switching of the FET 508, the terminal voltage, $V_i$, of the capacitor 514 increases and provides a desired current to the current control circuit 100. The maximum level of the voltage $V_i$ applied to the current control circuit 100 is controlled by selection of the zener reference voltage $V_{REF}$ applied to the positive input of the comparator 516 and by the AND circuit 518. The diode 510 is provided to protect the FET against overvoltages.

Provision of the DC-DC converter 500 is advantageous because it allows for a reduction in the size of the ignition transformer as a result of increasing the voltage at starting, even if the battery voltage $V_b$ drops, a voltage drop from 12 volts to 6 volts not being uncommon. Thus, the DC-DC converter 500 assures adequate spark plug voltage even under cold weather starting conditions when drops in the battery voltage $V_b$ are typically encountered. Also, use of the DC-DC converter 500 enables selection of a power MOS FET having a small current capacity.

Further advantages are realized by provision of the converter 500. For example, normally when the spark plus is discharging, it is required to have a very high peak power. However, the average power is relatively low (duty 20%). Since the peak current flows from the capacitor 514, the input current to the DC-DC converter 500 will correspond to the average power, and will be correspondly less than the peak current. Therefore, it is not necessary to use a big, low resistance, battery cable between the battery and the input to the converter 500, because at the low average current, a large voltage drop does not occur.

A further consideration is that the maximum power to the converter 500 (or flyback or ringing circuit) is usually predetermined, and therefore, even when an extremely high current is generated at its output, the output voltage will be reduced accordingly. Thus, when converter 500 is employed in combination with current control circuit 100, a synergistic effect is realized to keep the ignition current within the optimum range.

A further advantage of the invention as particularly provided by the combination of the current control circuit 100 and the switching circuit 200 is that current is controlled without reliance on loss producing resistors or semiconductor devices to limit the current. While such elements would produce undesirable losses, the invention's use of transformer 102 in theory has no losses, and in actual use only experiences a negligible loss in the transformer iron core and in the switch 202.

Obviously, numerous modifications and variations of the present invention are possible in light of the above teachings. For example, the above description of the present invention assumes a 4-cylinder engine, but the principles of the invention are readily applicable to 6- or 8- cylinder engines. It is therefore to be understood that within the scope of the appended claims, the invention may be practiced otherwise than as specifically described herein.

What is claimed as new and desired to be secured by Letters Patent of the United States is:

1. A high voltage generating circuit for an automotive ignition system including at least one spark plug, comprising:

a power source;

a current control circuit coupled to said power source for generating a linearly increasing current signal;

controlled high frequency switching means coupled to said current control circuit for initiating generation of said linearly increasing current signal, said controlled high frequency switching means having an output in the form of a high frequency voltage and a high frequency linearly increasing current;

ignition transformer means adapted to be coupled to said spark plug and connected to the output of said switching means for stepping up said high frequency voltage supplied from said switching means for application to said spark plug such that a breakdown voltage of said spark plug is exceeded and a linearly increasing current is developed across the electrodes of said spark plug; and firing angle control means coupled to said controlled high frequency switching means and said transformer means for controlling the timing of generation of said high frequency linearly increasing current between the electrodes of said spark plug.

2. A high voltage generating circuit according to claim 1, wherein said current control circuit comprises:

a transformer having a primary winding and a secondary winding, wherein one side of said primary and secondary windings are commonly connected to said power supply;

a first diode having an anode connected to another side of said primary winding and a cathode connected to said switching means; and a second diode connected in series between ground and another side of said secondary winding.

3. A high voltage generating circuit according to claim 1, wherein said switching means comprises:

a power switch having an input connected to said current control circuit, an output connected to said transformer means and a control input;

a transformer having a primary winding and a secondary winding, said secondary winding coupled to the control input of said power switch;

a drive circuit connected to the primary winding of said transformer; and a gated oscillator having an output connected to said drive circuit and an input connected to said firing angle control circuit, wherein application of a signal from said firing angle control circuit to the input of said oscillator produces ON and OFF switching of said power switch.

4. A high voltage generating circuit according to claim 2, wherein said switching circuit comprises:

a power switch having a source connected to said current control circuit, a drain connected to said transformer means and a gate;

a transformer having a primary winding and a secondary winding, said second winding coupled between the gate and drain of said power switch;

a drive circuit connected to the primary winding of said transformer; and a gated oscillator having an output connected to said drive circuit and an input connected to said firing angle control circuit, wherein application of a signal from said firing angle control circuit to the input of said oscillator produces ON and OFF switching of said power switch.

5. A high voltage generating circuit according to claim 1, adapted for use in an automotive ignition system including plural spark plugs, wherein said transformer means comprises:

plural ignition transformers, each having a primary winding having one end connected to said switching means and a secondary winding having one end adapted to be connected to a respective spark plug and another end connected to ground, said primary winding of each said ignition transformer having an other end;

plural ignition selection switching circuits connected to the other end of respective of said primary windings of said ignition transformers, each ignition selection switching circuit having an input coupled to said firing angle control circuit, said firing angle control circuit selecting a selected spark plug for ignition by applying an ignition signal to a respective ignition selection switching circuit.

6. A high voltage generating circuit according to claim 2, adapted for use in an automotive ignition system including plural spark plugs, wherein said transformer means comprises:

plural ignition transformers, each having a primary winding having one end connected to said switching means and a secondary winding having one end adapted to be connected to a respective spark plug and another end connected to ground, said primary winding of each said ignition transformer having an other end;

plural ignition selection switching circuits connected to the other end of respective of said primary windings of said ignition transformers, each ignition selection switching circuit having an input coupled to said firing angle control circuit, said firing angle control circuit selecting a selected spark plug for ignition by applying an ignition signal to a respective ignition selection switching circuit.

7. A high voltage generating circuit according to claim 3, adapted for use in an automotive ignition system including plural spark plugs, wherein said transformer means comprises:

plural ignition transformers, each having a primary winding having one end connected to said switching means and a secondary winding having one end adapted to be connected to a respective spark plug and another end connected to ground, said primary winding of each said ignition transformer having an other end;

plural ignition selection switching circuits connected to the other end of respective of said primary windings of said ignition transformers, each ignition selection switching circuit having an input coupled to said firing angle control circuit, said firing angle control circuit selecting a selected spark plug for ignition by applying an ignition signal to a respective ignition selection switching circuit.

8. A high voltage generating circuit according to claim 1, wherein said power supply comprises:

a DC-DC converter having an input adapted to be connected to an automotive battery and an output connected to said current control circuit, said DC-DC converter provided to step up the voltage of said automotive battery for application of said stepped up voltage to said current control circuit.

9. A high voltage generating circuit according to claim 2, wherein said power supply comprises:

a DC-DC converter having an input adapted to be connected to an automotive battery and an output connected to said current control circuit, said DC-DC converter provided to step up the voltage of said automotive battery for application of said stepped up voltage to said current control circuit.

10. A high voltage generating circuit according to claim 3, wherein said power supply comprises:

a DC-DC converter having an input adapted to be connected to an automotive battery and an output connected to said current control circuit, said DC-DC converter provided to step up the voltage of said automotive battery for application of said stepped up voltage to said current control circuit.

11. A high voltage generating circuit according to claim 4, wherein said power supply comprises:

a DC-DC converter having an input adapted to be connected to an automotive battery and an output connected to said current control circuit, said DC-DC converter provided to step up the voltage of said automotive battery for application of said stepped up voltage to said current control circuit.

12. A high voltage generating circuit according to claim 5, wherein said power supply comprises:

a DC-DC converter having an input adapted to be connected to an automotive battery and an output connected to said current control circuit, said DC-DC converter provided to step up the voltage of said automotive battery for application of said stepped up voltage to said current control circuit.

13. A high voltage generating circuit according to claim 6, wherein said power supply comprises:

a DC-DC converter having an input adapted to be connected to an automotive battery and an output connected to said current control circuit, said DC-DC converter provided to step up the voltage of said automotive battery for application of said stepped up voltage to said current control circuit.

14. A high voltage generating circuit according to claim 7, wherein said power supply comprises:

a DC-DC converter having an input adapted to be connected to an automotive battery and an output connected to said current control circuit, said DC-DC converter provided to step up the voltage of said automotive battery for application of said stepped up voltage to said current control circuit.

* * * * *